US010765193B2

(12) United States Patent
Domy

(10) Patent No.: US 10,765,193 B2
(45) Date of Patent: Sep. 8, 2020

(54) CAP OR CROWN OF A ROTATING COSMETIC CASING

(71) Applicant: REBOUL S.A.S., Chavanod (FR)

(72) Inventor: Michel Domy, Annecy (FR)

(73) Assignee: REBOUL S.A.S. (FR)

( * ) Notice: Subject to any disclaimer, the term of this patent is extended or adjusted under 35 U.S.C. 154(b) by 41 days.

(21) Appl. No.: 15/575,305

(22) PCT Filed: May 18, 2016

(86) PCT No.: PCT/FR2016/051173

§ 371 (c)(1),
(2) Date: Nov. 20, 2017

(87) PCT Pub. No.: WO2016/185137

PCT Pub. Date: Nov. 24, 2016

(65) Prior Publication Data

US 2018/0153277 A1 Jun. 7, 2018

(30) Foreign Application Priority Data

May 18, 2015 (FR) ..... 15 54425

(51) Int. Cl.
*A45D 40/04* (2006.01)

(52) U.S. Cl.
CPC ..... *A45D 40/04* (2013.01)

(58) Field of Classification Search
CPC ..... A45D 40/04; A45D 40/06; A45D 40/065; A45D 2040/208; A45D 40/12
(Continued)

(56) References Cited

U.S. PATENT DOCUMENTS 2,545,864 A * 3/1951 Thompson ..... A45D 40/06 401/61
4,812,066 A * 3/1989 Gueret ..... A45D 40/06 401/78

(Continued)

FOREIGN PATENT DOCUMENTS

DE 202012101695 U1 * 5/2012 ..... A45D 40/04

OTHER PUBLICATIONS

Machine Translation of DE 20201201695. Retrieved from Espacenet. (Year: 2019).*

(Continued)

*Primary Examiner* — Erin Deery
(74) *Attorney, Agent, or Firm* — Fay Sharpe LLP

(57) ABSTRACT

A rotating cosmetics case, including a cap or crown (1) mounted in the lower portion, in the extension of a sheath (2) with slide(s) (10) including in the upper portion an upper stopping element (8) protruding outwardly, in which is mounted a slideable cursor (3), intended to receive a cosmetics product, such as a stick of lipstick or lip cream, the cursor (3) being equipped with at least one lug (7) engaged in the slider (10) and extending into a spiral groove (6) of a spiral covering (4), the covering being fitted on the sheath (2), while the crown (1) comprises a body piece (16), supporting an upper portion including flexible strips (14) whose ends interact with the inner wall of the spiral covering (4), while the crown (1) further includes at least one flexible tab (15) whose upper end is assembled with the lower end of the spiral covering (4).

20 Claims, 2 Drawing Sheets

(58) Field of Classification Search
USPC ..... 401/68, 65, 77, 78
See application file for complete search history.

(56) References Cited

U.S. PATENT DOCUMENTS

| | | | | | |
|---|---|---|---|---|---|
| 5,096,318 | A * | 3/1992 | Susini | A45D 40/06 | 401/80 |
| 5,143,464 | A * | 9/1992 | Susini | A45D 40/06 | 401/69 |
| 5,348,410 | A * | 9/1994 | Shozi | A45D 40/06 | 401/78 |
| 5,842,803 | A * | 12/1998 | Fumell | A45D 40/06 | 401/78 |
| 6,036,387 | A * | 3/2000 | Gueret | A45D 40/06 | 401/78 |
| 6,109,808 | A | 8/2000 | Susini et al. | | |
| 2007/0059088 | A1 * | 3/2007 | Chan | A45D 40/06 | 401/75 |

OTHER PUBLICATIONS

International Search Report (with English translation) dated Sep. 1, 2016 for International Application No. PCT/FR2016/051173.
Written Opinion dated Sep. 1, 2016 for International Application No. PCT/FR2016/051173.
International Preliminary Report on Patentability (with English translation) prepared Nov. 21, 2017 for International Application No. PCT/FR2016/051173.

* cited by examiner

CAP OR CROWN OF A ROTATING COSMETIC CASING

FIELD OF INVENTION

The present invention relates to a crown of a rotating case, of the type used to contain cosmetics products, such as a stick of lipstick or lip creams.

BACKGROUND OF THE INVENTION

A rotating cosmetics case conventionally consists of a secured crown mounted with a sheath with a slide, in which is arranged a cursor for receiving a cosmetics product. A spiral covering is fitted on the sheath and held by a stopping means located in the upper and lower portion of thissheath. However, the design of the spiral covering is such that the spiral covering has, in general, an axial clearance between the two stopping means. The rotating cosmetics case is further closed by a cap, this cap being fitted directly on the spiral covering or via a jacket, generally metallic, secured to the spiral covering. The axial clearance of the spiral covering affects the closing of the cap. This clearance gives the impression that the case is poorly closed, which is unsightly.

SUMMARY OF THE INVENTION

The present invention thus proposes a new crown of a rotating cosmetics case, making it possible to overcome the aforementioned disadvantages.

Thus, the rotating cosmetics case, according to the invention, comprises a crown mounted in a lower portion of a sheath, in an extension of the sheath. The sheath comprises in the upper portion, an outwardly protruding upper stopping means. A slidable cursor is mounted in the sheath for receiving a cosmetics product, such as a stick of lipstick or lip cream, said cursor being equipped with at least one lug that extends in a spiral groove of a spiral covering that is fitted on said sheath. The crown comprises a body piece including an upper portion comprising flexible strips whose ends interact with the inner wall of the spiral covering, while the crown further comprises at least one flexible tab whose upper end engages the lower end of the spiral covering.

It should be added that the at least one flexible tab has a height less than that of the flexible strips.

It is to be noted that the at least one flexible tab is presented advantageously in the form of an arch composed of two vertical walls, connected by a horizontal wall, surmounted by a pivot, wherein the pivot engages the lower end of the spiral covering.

It is to be noted that the distance between the lower end of the upper stopping means of the sheath and the upper end of the body piece of the crown is less than the sum of the heights of the spiral covering and a flexible tab.

According to one characteristic, a flexible tab is arranged between two flexible strips.

According to one additional characteristic, the sheath comprises a lower stopping means, and a jacket is fitted and held fast on the spiral covering. The spiral covering can be composed of two cylindrical portions, of two different sections, the first cylindrical portion having the smallest section, and its inner face being arranged correspondingly to the outer face of the sheath, the upper end of the first cylindrical portion stopping against the upper stopping means of the sheath, while its lower end, arranged inside the second cylindrical portion, comes correspondingly from the lower stopping means of the sheath, the second cylindrical portion having the larger section, and its outer upper end engaging the lower end of the jacket.

It should be noted that according to the preceding characteristic, the ends of the flexible strips interact with the inner wall of the second cylindrical portion of the spiral covering, while the at least one flexible tab is engaged with the lower end of the second cylindrical portion of the spiral covering.

BRIEF DESCRIPTION OF THE DRAWINGS

Other features and advantages of the invention will become apparent from the description which follows, with reference to the accompanying drawings which are given by way of non-limiting examples.

DETAILED DESCRIPTION OF THE INVENTION

Figure 1:
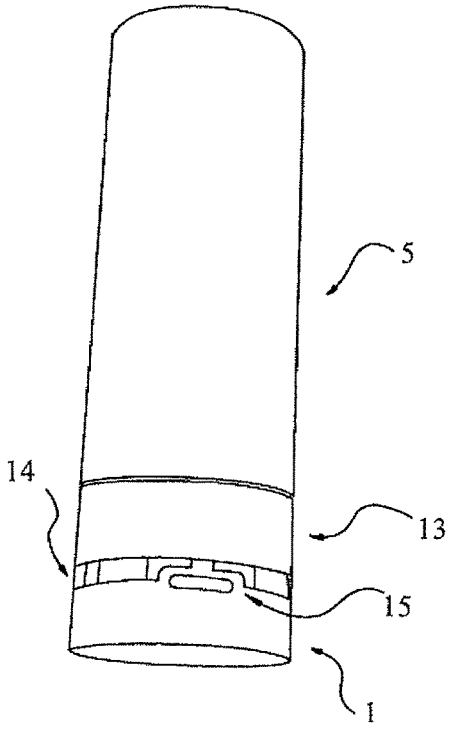
FIG. 1 is a front view of a cosmetics case.
Figure 2:
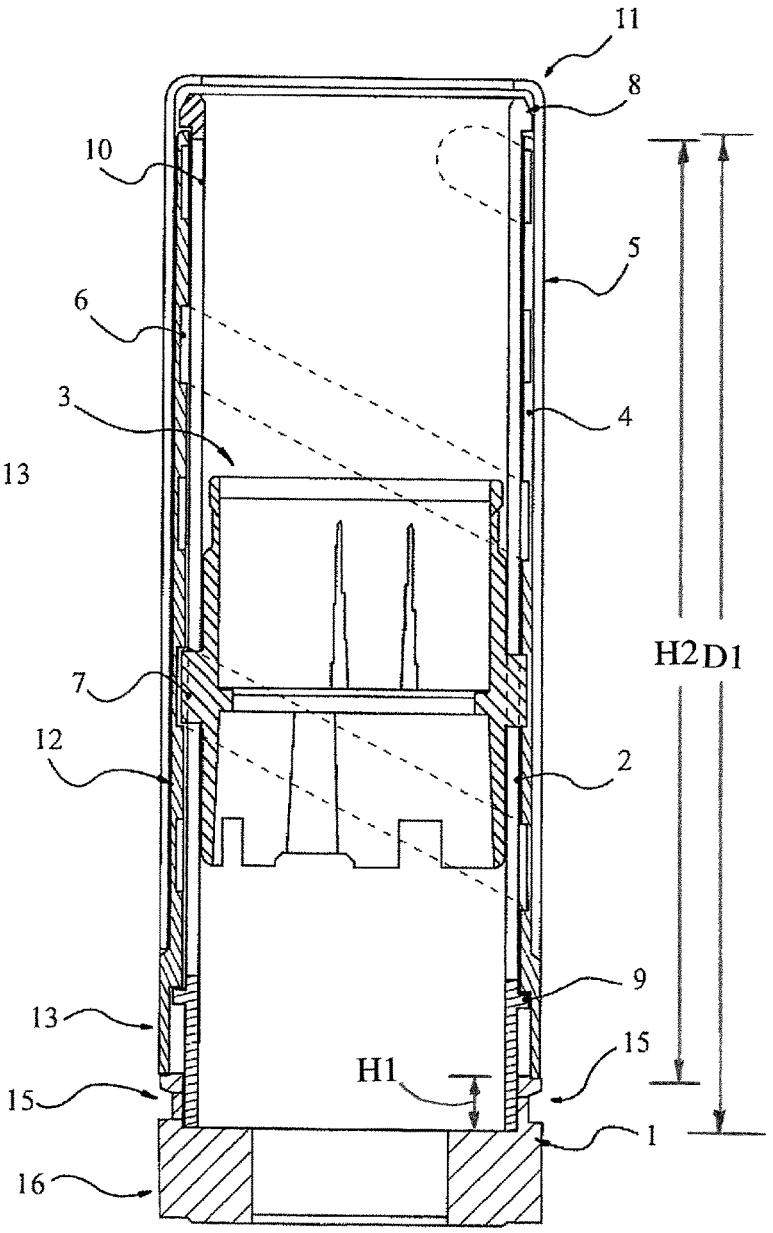
FIG. 2 is a sectional view of a cosmetic case.

Thus, a rotating case, as illustrated in FIG. 2, is advantageously composed of a crown (1) secured to or forming an integral part of a sheath (2) with a slide (10), inside which is mounted a mobile, moving cursor (3) for receiving a cosmetics product. The sheath (2) is encased in a spiral covering (4) mounted in conjunction with a jacket (5). The sheath (2) and the crown (1) form a subassembly, mounted to move freely in axial rotation relative to the assembly formed by the spiral covering (4) and the jacket (5).

The jacket (5) is advantageously metallic.

In the following description, it is understood that the rotating case is in the position for use, namely the crown (1) is directed downwards.

The sheath (2) with slide (10), allows engagement of the cursor (3) in axial translation during the axial rotation of the assembly formed by the crown (1) and the sheath (2). This assembly is arranged in such a way that the axial rotation of the crown (1) engages the sliding cursor (3) in a twisting motion. This movement breaks down into a rotation and a translation, both simultaneously and axially with respect to the assembly formed by the spiral covering (4) and the jacket (5).

It is to be noted that the sheath (2) advantageously comprises two slides (10) arranged diametrically opposite, formed longitudinally in at least one portion of its cylindrical wall.

It is to be noted that the sheath (2) comprises an upper stopping means (8) and a lower stopping means (9) protruding outwardly. In other words, these stopping means (8, 9) are advantageously represented by annular peripheral ribs.

The spiral covering (4) has in its wall at least one spiral groove (6) closed at least at its upper end, preferably two spiral grooves (6), diametrically opposite. The at least one groove (6) is a non-through bore.

The spiral covering (4) is retained by the upper stopping means (8) and the lower stopping means (9) of the sheath (2).

The metal jacket (5) advantageously comprises, in the upper portion, a flange (11), protruding inwards.

The cursor (3) further comprises at least one lug (7) passing through the at least one slide (10) of the sheath (2) and cooperating with the at least one groove (6) of the covering (4). The at least one lug (7) thus cooperates in a slidable fashion with at least one slide (10) for engaging the cursor (3) in axial translation with respect to the crown (1), during the rotation of the assembly formed by the spiral covering (4) and the jacket (5), in cooperation with at least one spiral groove (6).

The upper portion of the crown (1) is inserted between the outer portion of the sheath (2) and the inner portion of the spiral covering (4), below the lower stopping means (9) of the sheath (2).

According to one embodiment, the rotating cosmetics case is provided with a closure cap, which is detachably positioned directly at the free end of the case, and comes into a closed position and is positioned around the jacket (5) in order to completely hermetically close the rotating case.

According to another embodiment, the closure cap is positioned indirectly around the jacket (5), via an annular rib arranged at the lower periphery thereof.

Figure 3:
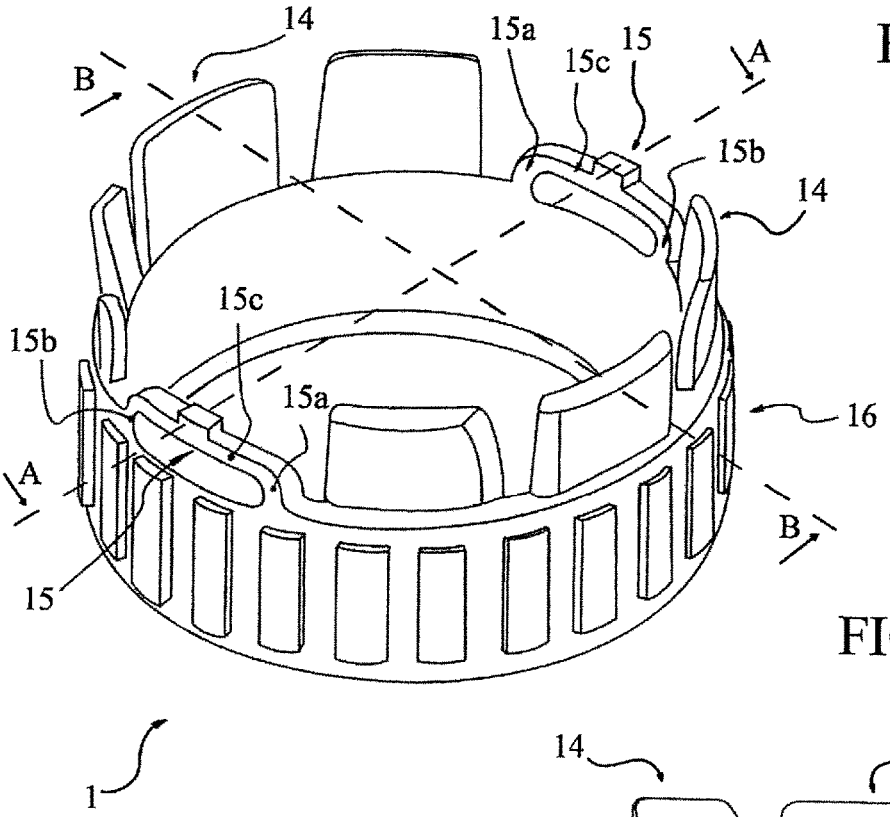
FIG. 3 is a perspective view of a crown according to one embodiment of the invention.
Figure 4:
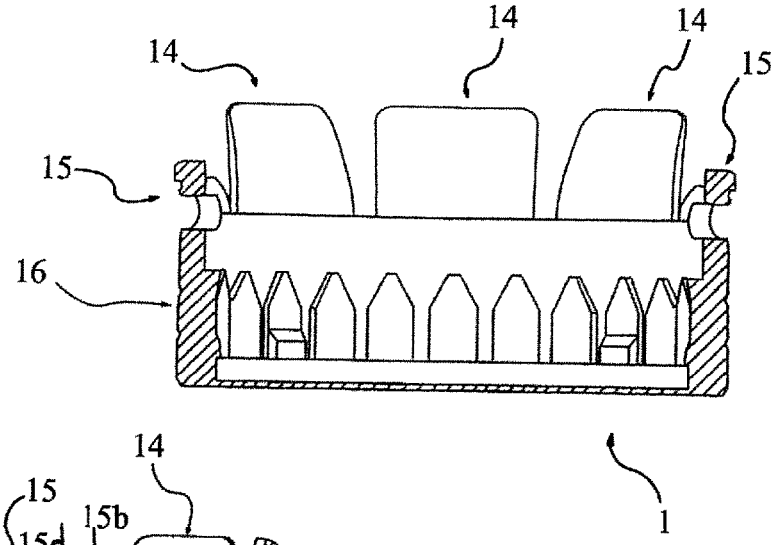
FIG. 4 is a sectional view along A-A of FIG. 3.
Figure 5:
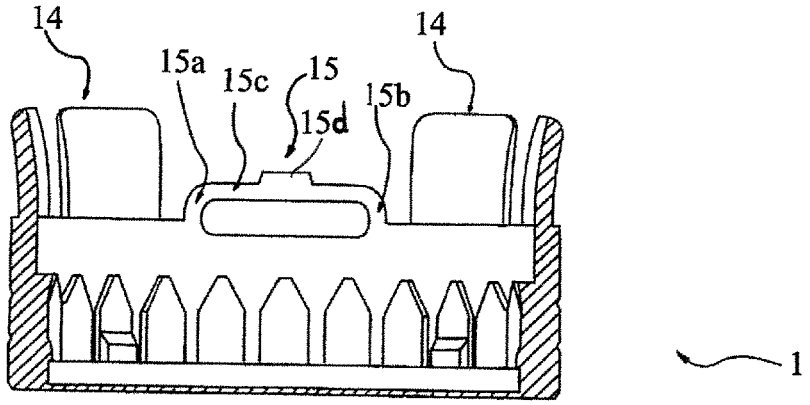
FIG. 5 is a sectional view along B-B of FIG. 3.

It should be added that the crown (1), as illustrated in FIGS. 3 to 5, comprises a body piece (16), supporting an upper portion composed of flexible strips (14) and at least one flexible tab (15), preferably two flexible tabs (15) arranged diametrically opposite.

It should be noted that the flexible strips (14) extend upward, and are oriented in the opposite direction to the base of the rotating case. These strips (14) are directed outward at their ends relative to the body piece (16). The ends of the flexible strips (14) interact with the inner wall of the spiral covering (4), more precisely with the inner wall of the second cylindrical portion (13) of the spiral covering (4), as explained more in detail below. These flexible strips (14) absorb the radial clearance of the rotating case, control the torque and thus slow the rotation of the assembly formed by the spiral covering (4) and the jacket (5), providing ease of use.

According to one characteristic, the flexible tab(s) (15) has/have (a) lower height(s) (H1) than those of the flexible strips (14). The at least one flexible tab (15) is arranged in such a way that its upper end supports the lower end of the spiral covering (4), more specifically supports the lower end of the second cylindrical portion (13) of the spiral covering (4), as explained in more detail below.

According to one embodiment, at least one flexible tab (15) is in the form of an arch composed of two vertical walls (15*a*,15*b*), connected by a horizontal wall (15*c*), surmounted by a pivot (15*d*).

According to the previous embodiment, the upper end of the spiral covering (4) stops against the upper stopping means (8) of the sheath (2), while the lower end of the spiral covering (4) stops in compression against the pivot (15*d*) of the flexible tab (15), causing a bending of the vertical walls (15*a*,15*b*) of the flexible tab (15), ensuring the maintenance of the spiral covering (4) and eliminating the axial clearance of the spiral covering.

It is understood that a flexible lug (15) according to the invention can be arranged in another form, while keeping the characteristics of maintaining compression and eliminating the axial clearance of the spiral covering (4).

According to a complementary feature, a flexible tab (15) is arranged between two flexible strips (14).

It should be noted that the spiral covering (4) is composed of two cylindrical portions (12, 13) from two different sections. The first cylindrical portion (12), which comprises at least one spiral groove (6) in its wall, opening towards the inside, has the smallest section, and its internal face is arranged correspondingly from the outer face of the sheath (2). The upper end of the first portion (12) stops against the upper stopping means (8) of the sheath (2), while its lower end, arranged inside the second cylindrical portion (13), comes correspondingly from the lower stopping means (9) of the sheath (2). The second cylindrical portion (13) has the larger section, and its outer upper end engages the lower end of the jacket (5), while its inner face engages the crown, namely the flexible strips (14) of the crown (1). The lower end of the second cylindrical portion (13) of the spiral envelope (4) stops against the at least one flexible tab (15).

According to one embodiment, the sheath (2) does not comprise a lower stopping means (9).

According to another embodiment, the spiral covering (4) consists of the same profile and is therefore not made up of two portions of different section. According to this latter embodiment, the cosmetics case advantageously does not include a jacket (5).

An axial clearance of the spiral covering (4) is present because the distance between the lower end of the upper stopping means (8) and the upper end of the lower stopping means (9) of the sheath (2) is greater than the height of the first cylindrical portion (12) of the spiral covering (4).

The axial clearance of the spiral covering (4) is eliminated in that the distance D1 between the lower end of the upper stopping means (8) of the sheath (2) and the upper end of the body piece of the crown (1), is less than the sum of the height (H1) of the flexible tab (15) and the height (H2) of the spiral covering (4).

Note that the spiral covering (4) being secured with the jacket (5), the closing cap which fits on the jacket (5), the elimination of the axial clearance of the spiral covering (4), eliminates the axial clearance of the closing cap. This feature makes it possible to provide a rotating case of very good quality, having a rendering and a finish unrivaled with respect to cases available on the market, with no visually unattractive clearance and with a perceivable sensation when closing securely.

According to an alternative of the invention, the at least one flexible tab (15) is not arranged on the body piece of the crown (1), but rather on the lower end of the spiral covering (4). According to this alternative, the lower end of at least one flexible tab (15) presses against the upper end of the body piece of the crown (1), ensuring the maintenance of the spiral covering (4) and removing the axial clearance of this latter.

The invention claimed is:

1. A rotating cosmetics case comprising:

a crown (1) mounted to a lower portion of a sheath (2), said sheath comprising at least one slide (10) and comprising an upper portion that includes an upper stopping means (8) protruding outwardly;

a covering (4) fitted on the sheath, said covering comprising at least one spiral groove;

a slidable cursor (3) mounted in the sheath and adapted to receive a cosmetics product, said cursor (3) being equipped with at least one lug (7) engaged in said at least one slide (10) of the sheath (2) and extending outwardly through said at least one slide into said at least one spiral groove (6) of said covering (4);

said crown (1) comprising a body piece (16) and an upper portion connected to the body piece, said upper portion comprising a plurality of flexible strips (14) that extend upwardly from the body piece (16), said plurality of flexible strips each comprising an upper end that engages an inner wall of a lower end of the covering (4), wherein the crown (1) further comprises at least one flexible tab (15) projecting upwardly from the body piece, said at least one flexible tab (15) comprising an upper end that contacts the lower end of the covering (4) such that said at least one flexible tab (15) bends and resiliently urges said covering (4) away from said body piece of said crown toward said upper stopping means.

2. The rotating cosmetics case according to claim 1, wherein the at least one flexible tab (15) has a height relative to said body piece that is less than a height of the flexible strips (14) relative to said body piece.

3. The rotating cosmetics case according to claim 2, wherein the at least one flexible tab (15) is in the form of an arch comprising two vertical walls (15*a*,15*b*), connected by a horizontal wall (15*c*), surmounted by a pivot (15*d*), wherein the pivot (15*d*) contacts the lower end of the covering (4).

4. The rotating cosmetics case according to claim 2, wherein a distance between a lower end of the upper stopping means (8) of the sheath (2) and an upper end of the body piece of the crown (1) is less than a sum of a height of the covering (4) and the height of the at least one flexible tab (15).

5. The rotating cosmetics case according to claim 2, wherein the at least one flexible tab (15) is arranged between two flexible strips of the plurality of flexible strips (14).

6. The rotating cosmetics case according to claim 2, wherein the sheath (2) comprises a lower stopping means (9), and said rotating cosmetics case further comprises a jacket (5) fitted and secured to the covering (4), wherein the covering comprises first and second cylindrical portions (12, 13) respectively comprising first and second different sections, wherein the first section is smaller than the second section, the first cylindrical portion (12) comprising an internal face arranged correspondingly with respect to an outer face of the sheath (2), wherein an upper end of the first portion (12) stops against the upper stopping means (8) of the sheath (2), while a lower end of the first cylindrical portion contacts the lower stopping means of the sheath (2), and wherein an outer upper end of the second cylindrical portion contacts a lower end of the jacket (5).

7. The rotating cosmetics case according to claim 1, wherein the at least one flexible tab (15) is in the form of an arch comprising two vertical walls (15*a*,15*b*), connected by a horizontal wall (15*c*), surmounted by a pivot (15*d*), wherein the pivot (15*d*) contacts the lower end of the covering (4).

8. The rotating cosmetics case according to claim 7, wherein a distance between the lower end of the upper stopping means (8) of the sheath (2) and the upper end of the body piece of the crown (1) is less than a sum of a height of the covering (4) and a height of the at least one flexible tab (15).

9. The rotating cosmetics case according to claim 7, wherein the at least one flexible tab (15) is arranged between two flexible strips of the plurality of flexible strips (14).

10. The rotating cosmetics case according to claim 7, wherein the sheath (2) comprises a lower stopping means (9), and said rotating cosmetics case further comprises a jacket (5) fitted and secured to the covering (4), wherein the covering comprises first and second cylindrical portions (12, 13) respectively comprising first and second different sections, wherein the first section is smaller than the second section, the first cylindrical portion (12) comprising an internal face arranged correspondingly with respect to an outer face of the sheath (2), wherein an upper end of the first cylindrical portion (12) stops against the upper stopping means (8) of the sheath (2), while a lower end of the first cylindrical portion contacts the lower stopping means of the sheath (2), and wherein an outer upper end of the second cylindrical portion contacts a lower end of the jacket (5).

11. The rotating cosmetics case according to claim 1, wherein a distance between a lower end of the upper stopping means (8) of the sheath (2) and an upper end of the body piece of the crown (1) is less than a sum of a height of the covering (4) and a height of the at least one flexible tab (15).

12. The rotating cosmetics case according to claim 11, wherein the at least one flexible tab (15) is arranged between two flexible strips of the plurality of flexible strips (14).

13. The rotating cosmetics case according to claim 11, wherein the sheath (2) comprises a lower stopping means (9), and said rotating cosmetics case further comprises a jacket (5) fitted and secured to the covering (4), wherein the covering comprises first and second cylindrical portions (12, 13) respectively comprising first and second different sections, wherein the first section is smaller than the second section, the first cylindrical portion (12) comprising an internal face arranged correspondingly with respect to an outer face of the sheath (2), wherein an upper end of the first cylindrical portion (12) stops against the upper stopping means (8) of the sheath (2), while a lower end of the first cylindrical portion contacts the lower stopping means of the sheath (2), and wherein an outer upper end of the second cylindrical portion contacts a lower end of the jacket (5).

14. The rotating cosmetics case according to claim 1, wherein the at least one flexible tab (15) is arranged between two flexible strips of the plurality of flexible strips (14).

15. The rotating cosmetics case according to claim 14, wherein the sheath (2) comprises a lower stopping means (9), and said rotating cosmetics case further comprises a jacket (5) fitted and secured to the covering (4), wherein the covering comprises first and second cylindrical portions (12, 13) respectively comprising first and second different sections, wherein the first section is smaller than the second section, the first cylindrical portion (12) its comprising an internal face arranged correspondingly with respect to an outer face of the sheath (2), wherein an upper end of the first cylindrical portion (12) stops against the upper stopping means (8) of the sheath (2), while a lower end of the first cylindrical portion contacts the lower stopping means of the sheath (2), and wherein an outer upper end of the second cylindrical portion contacts a lower end of the jacket (5).

16. The rotating cosmetics case according to claim 15, wherein each upper end of the plurality of flexible strips (14) interacts with an inner wall of the second cylindrical portion (13) of the covering (4).

17. The rotating cosmetics case according to claim 1, wherein the sheath (2) comprises a lower stopping means (9), and said rotating cosmetics case further comprises a jacket (5) fitted and secured to the covering (4), wherein the covering comprises first and second cylindrical portions (12, 13) respectively comprising first and second different sections, wherein the first section is smaller than the second section, the first cylindrical portion (12) comprising an internal face arranged correspondingly with respect to an outer face of the sheath (2), wherein an upper end of the first cylindrical portion (12) stops against the upper stopping means (8) of the sheath (2), while a lower end of the first cylindrical portion contacts the lower stopping means of the sheath (2), and wherein an outer upper end of the second cylindrical portion contacts a lower end of the jacket (5).

18. The rotating cosmetics case according to claim 17, wherein each upper end of the plurality of flexible strips (14) interacts with an inner wall of the second cylindrical portion (13) of the covering (4).

19. The rotating cosmetics case according to claim 17, wherein the upper end of the at least one flexible tab (15) is abutted with a lower end of the second cylindrical portion (13) of the covering (4).

20. A rotating cosmetics case, comprising:

a crown mounted on a lower end of a slide sheath, said slide sheath comprising first and second slides defined therein, and said slide sheath further comprising a stop at an upper end spaced from the crown;

a cover located on the slide sheath between said crown and said stop, said cover comprising first and second spiral grooves oriented inwardly toward said slide sheath;

a slidable cursor intended to hold an associated cosmetics product, said cursor movably located inside said slide sheath and comprising at least one first and second lugs slidably located respectively in said first and second slides, wherein said first and second lugs extend respectively through the first and second slides and are engaged respectively in the first and second spiral grooves of the cover such that rotation of said crown and sheath relative to said cover induces axial transaction of said cursor inside said slide sheath relative to said crown based upon movement of said first and second spiral grooves relative to said first and second lugs of said cursor;

the crown comprising a body including an upper portion comprising a plurality of flexible strips extending upwardly therefrom and each comprising an upper end spaced from the body and in contact with an inner wall of the cover, said crown further comprising at least one flexible tab projecting upwardly from the body, said at least one flexible tab including an upper end that is spaced from the body of the crown and engaged with a lower end of the cover such that said at least one flexible tab bends and urges said cover upwardly away from said body of said crown into contact with said stop of said sheath.

* * * * *